US009198511B2

(12) United States Patent
Pendleton

(10) Patent No.: US 9,198,511 B2
(45) Date of Patent: Dec. 1, 2015

(54) SAFES WITH ROTATING INNER SUPPORTS AND INTERIOR PISTOL SHELVES

(71) Applicant: Pendleton Safe Company, Loganville, GA (US)

(72) Inventor: Bruce Pendleton, Loganville, GA (US)

( * ) Notice: Subject to any disclaimer, the term of this patent is extended or adjusted under 35 U.S.C. 154(b) by 0 days.

(21) Appl. No.: 14/264,034

(22) Filed: Apr. 28, 2014

(65) Prior Publication Data

US 2014/0345507 A1 Nov. 27, 2014

Related U.S. Application Data

(60) Provisional application No. 61/816,608, filed on Apr. 26, 2013.

(51) Int. Cl.

| | |
|---|---|
| ***E05G 1/00*** | (2006.01) |
| ***A47B 81/00*** | (2006.01) |
| ***A47B 49/00*** | (2006.01) |
| ***E05G 1/06*** | (2006.01) |
| *E05G 1/02* | (2006.01) |

(52) U.S. Cl.

CPC ..... *A47B 81/005* (2013.01); *A47B 49/00* (2013.01); *A47B 49/004* (2013.01); *E05G 1/06* (2013.01); *E05G 1/02* (2013.01)

(58) Field of Classification Search

CPC ..... A47B 81/005; E05G 1/00; A47F 7/0028; A47F 5/0838; A47F 5/0861; A47F 7/024

USPC ..... 109/45, 48, 50, 51; 211/4, 64; 312/305, 312/351.1

See application file for complete search history.

(56) References Cited

U.S. PATENT DOCUMENTS

| | | | | | |
|---|---|---|---|---|---|
| 946,852 | A | * | 1/1910 | Boye | 312/72 |
| 1,389,181 | A | * | 8/1921 | Benson | 312/305 |
| 3,031,069 | A | * | 4/1962 | Hirsch | 206/317 |
| 4,113,107 | A | * | 9/1978 | Jaeger | 211/4 |
| D252,125 | S | * | 6/1979 | Oakley et al. | D6/432 |
| 4,249,464 | A | | 2/1981 | Hansen | |
| 4,587,908 | A | * | 5/1986 | DeBruyn | 108/142 |
| 4,796,960 | A | * | 1/1989 | Candelas | 312/305 |
| D341,276 | S | | 11/1993 | Jones | |
| D348,576 | S | * | 7/1994 | Narramore | D6/470 |
| D354,862 | S | | 1/1995 | Goldberg | |
| D379,881 | S | * | 6/1997 | Gregg et al. | D6/457 |
| D485,458 | S | | 1/2004 | Govrik et al. | |
| D485,717 | S | | 1/2004 | Boron | |
| D485,718 | S | | 1/2004 | Boron | |
| D493,311 | S | | 7/2004 | Searer | |
| D509,390 | S | | 9/2005 | Boron et al. | |
| D511,639 | S | | 11/2005 | Boron et al. | |
| D519,303 | S | | 4/2006 | Winig et al. | |

(Continued)

*Primary Examiner* — Suzanne Barrett
(74) *Attorney, Agent, or Firm* — Brient Globerman, LLC

(57) ABSTRACT

A gun safe, according to various embodiments, comprises: (1) a secure housing defining an interior and an opening; (2) a door; and (3) a vertical array of shelves within the interior of the secure housing immediately adjacent a lateral portion of the opening. In various embodiments, each of the shelves defines a handgun support portion that comprises a cutout that is dimensioned to allow a portion of a handgun to extend through the cutout as the handgun is supported on opposite sides of the handgun by the shelf. In particular embodiments, the gun safe further comprises at least one shelf disposed within the interior of the secure housing that is configured to rotate about a central axis and defines one or more handgun support portions.

11 Claims, 10 Drawing Sheets

(56) References Cited

U.S. PATENT DOCUMENTS

| | | | | |
|---|---|---|---|---|
| D559,596 | S | 1/2008 | Matty et al. | |
| D570,630 | S | 6/2008 | D'Angelo | |
| D609,511 | S | 2/2010 | Ladner | |
| 7,770,740 | B2 * | 8/2010 | Punzel et al. | 211/64 |
| D674,631 | S | 1/2013 | Blanc | |
| 8,376,152 | B2 * | 2/2013 | Holmes, Jr. | 211/64 |
| 2003/0173321 | A1 | 9/2003 | Craft et al. | |
| 2004/0045914 | A1 * | 3/2004 | Sells et al. | 211/4 |
| 2004/0140235 | A1 * | 7/2004 | Cleveland et al. | 206/315.11 |
| 2007/0000851 | A1 * | 1/2007 | Matzick | 211/64 |
| 2008/0229983 | A1 * | 9/2008 | Pendleton | 109/45 |
| 2012/0261368 | A1 * | 10/2012 | Klein et al. | 211/64 |
| 2014/0345507 | A1 * | 11/2014 | Pendleton | 109/48 |

* cited by examiner

SAFES WITH ROTATING INNER SUPPORTS AND INTERIOR PISTOL SHELVES

CROSS-REFERENCE TO RELATED APPLICATIONS

This application claims the benefit of U.S. Provisional Patent Application No. 61/816,608, filed Apr. 26, 2013, entitled "Safes with Rotating Inner Supports and Interior Pistol Shelves," which is hereby incorporated herein by reference in its entirety.

BACKGROUND

Pistol collectors have been frustrated in the past with the lack of options for conveniently and securely storing their pistols in a way that they can view and access the pistols—especially large numbers of pistols. There is a currently a need for improved safe designs to address this issue.

SUMMARY

A gun safe, according to various embodiments, comprises: (1) a secure housing defining an interior and an opening; (2) a door that is movable between: (a) a first, open position in which the door prevents access to the interior of the secure housing; and (b) a second, closed position in which the door does not prevent access to the interior of the secure housing; and (3) a vertical array of shelves that is disposed within the interior of the secure housing immediately adjacent a lateral portion of the opening. In various embodiments, each of the shelves defines a handgun support portion that comprises a cutout that is dimensioned to allow a portion of a handgun to extend through the cutout as the handgun is supported on opposite sides of the handgun by the shelf.

A gun safe according to particular embodiments, comprises: (1) a secure housing defining an interior and an opening; (2) a door that is movable between: (a) a first, open position in which the door prevents access to the interior of the secure housing; and (b) a second, closed position in which the door does not prevent access to the interior of the secure housing; and (3) a shelf that is adapted to rotate about a central axis. In certain embodiments, the shelf defines: (1) a first handgun support portion that comprises a first type of cutout that is dimensioned to allow a portion of a first handgun to extend through the first type of cutout as the first handgun is supported on opposite sides of the first handgun by the shelf; and (2) a second handgun support portion that comprises a second type of cutout that is dimensioned to allow a portion of a second handgun to extend through the second type of cutout as the second handgun is supported on opposite sides of the second handgun by the shelf. In some embodiments, the first type of cutout is smaller than the second type of cutout. The first and second type of cutouts may be, for example, substantially in the shape of a keyhole, a diamond, a triangle, or any other suitable shape.

A gun safe according to certain embodiments comprises: (1) a secure housing defining an interior and an opening; (2) a door that is movable between: (a) a first, open position in which the door prevents access to the interior of the secure housing; and (b) a second, closed position in which the door does not prevent access to the interior of the secure housing; and (3) a shelving arrangement that is adapted to rotate about a central axis. In particular embodiments, the shelving arrangement comprises: (1) a first vertical array of half-circular shelves, each half-circular shelf within the first vertical array being positioned so that its outer perimeter at least substantially aligns with the respective outer perimeters of the other shelves in the first array; and (2) a second vertical array of half-circular shelves, each half-circular shelf within the second vertical array being positioned so that its outer perimeter at least substantially aligns with the respective outer perimeters of the other shelves in the second array. In certain embodiments, at least one of the first vertical array of half-circular shelves and at least one of the second vertical array of half-circular shelves cooperate to form a substantially circular shelf.

BRIEF DESCRIPTION OF THE DRAWINGS

Figure 1:
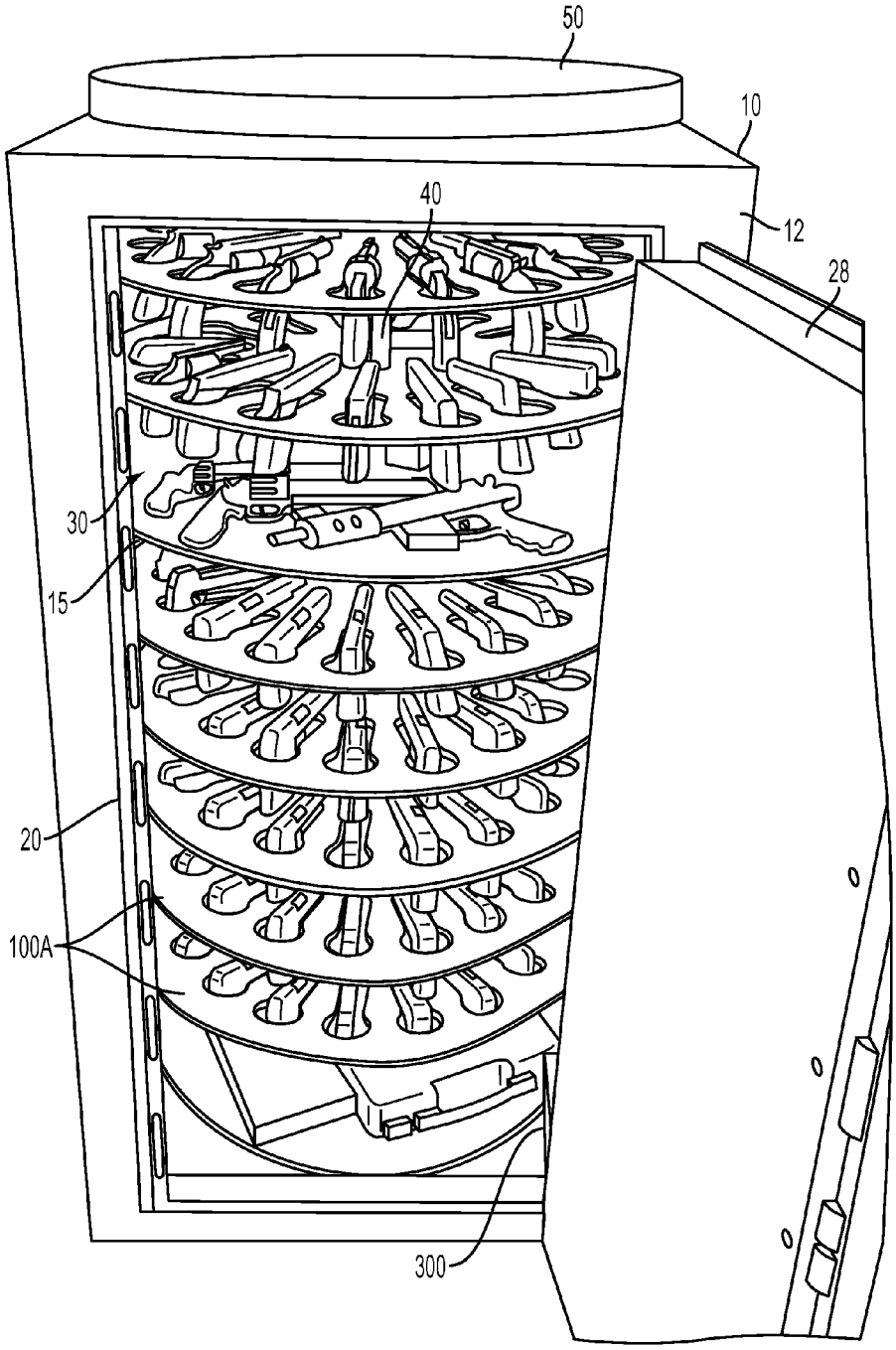

Having thus described various embodiments in general terms, reference will now be made to the accompanying drawings, which are not necessarily drawn to scale, and wherein:

FIG. 1 is a front perspective view of a gun safe, according to a particular embodiment, in an open position; the safe is loaded with a variety of different pistols.

Figure 2:
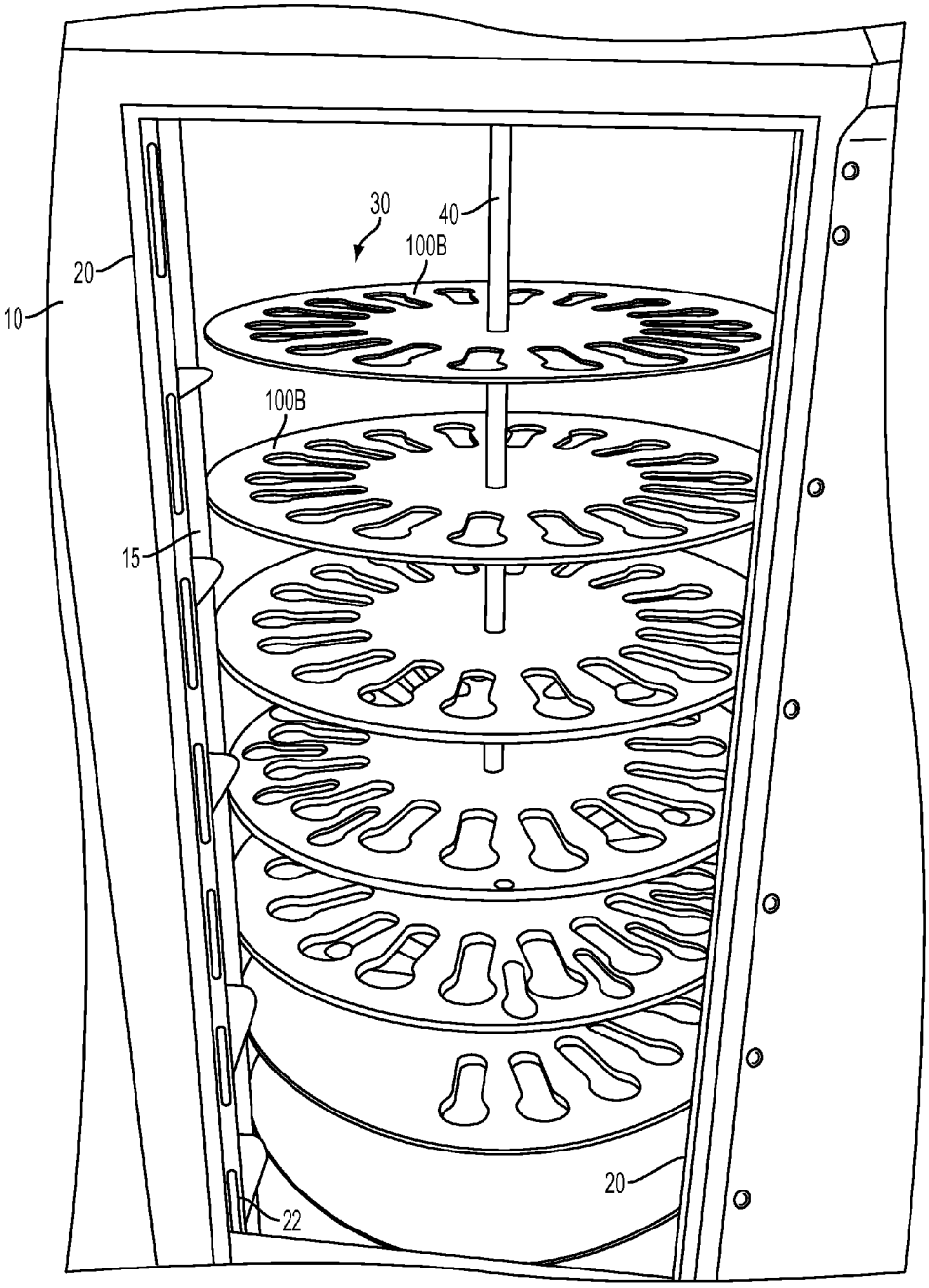

FIG. 2 is a front perspective view of the gun safe of FIG. 1 in which the shelving arrangement has been modified; the safe is not loaded with firearms.

Figure 3:
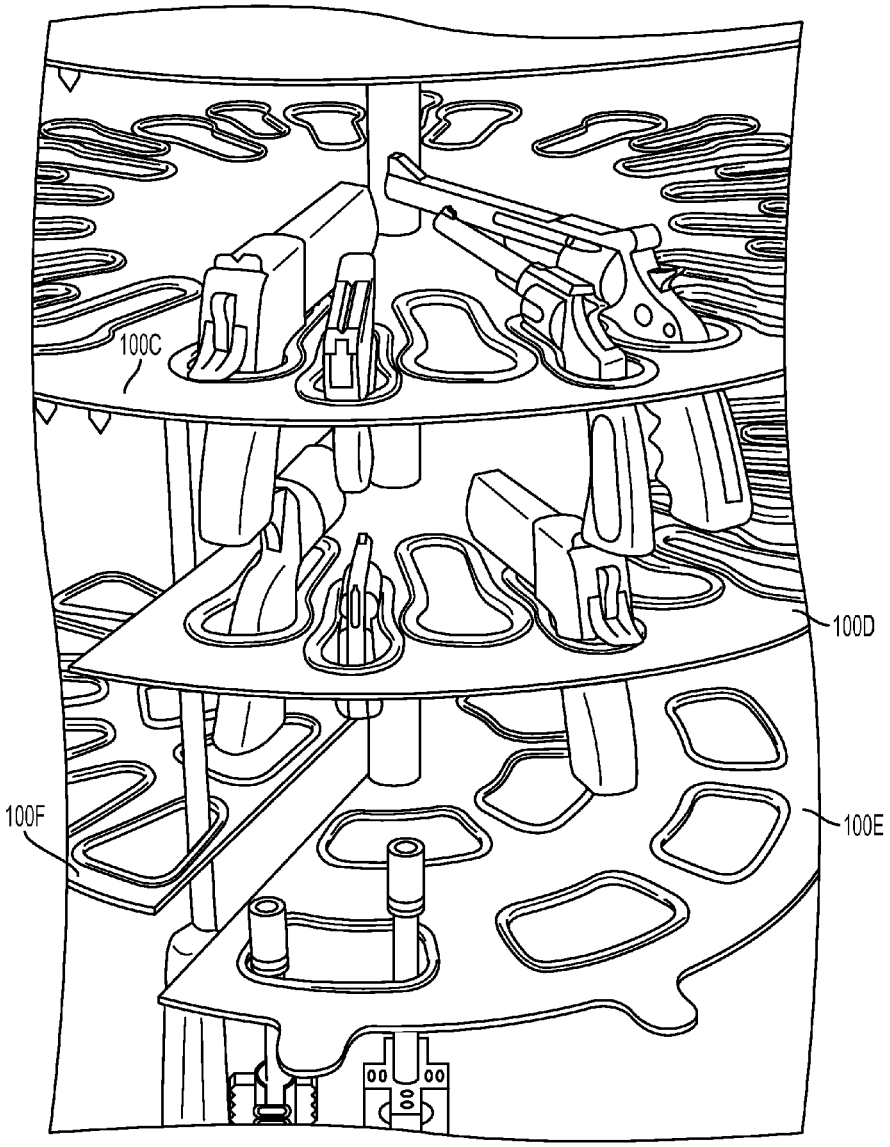

FIG. 3 is a front perspective view of the interior of the gun safe of FIG. 1 in which the shelving arrangement has been modified; the safe is partially loaded with pistols in the upper shelves, and with long guns in the lower shelves.

Figure 4:
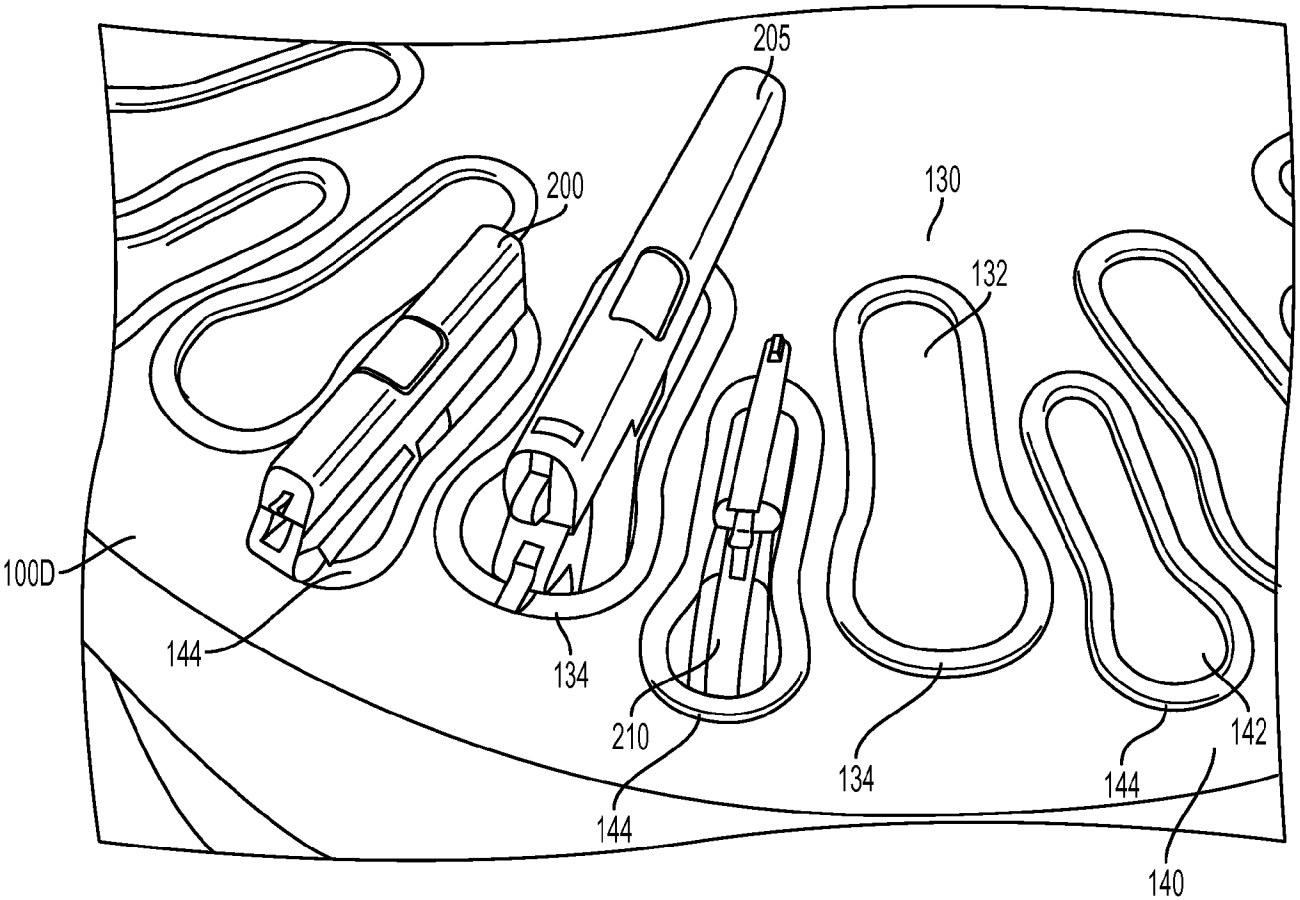

FIG. 4 is a top perspective view of the top shelf of FIG. 3.

Figure 5:
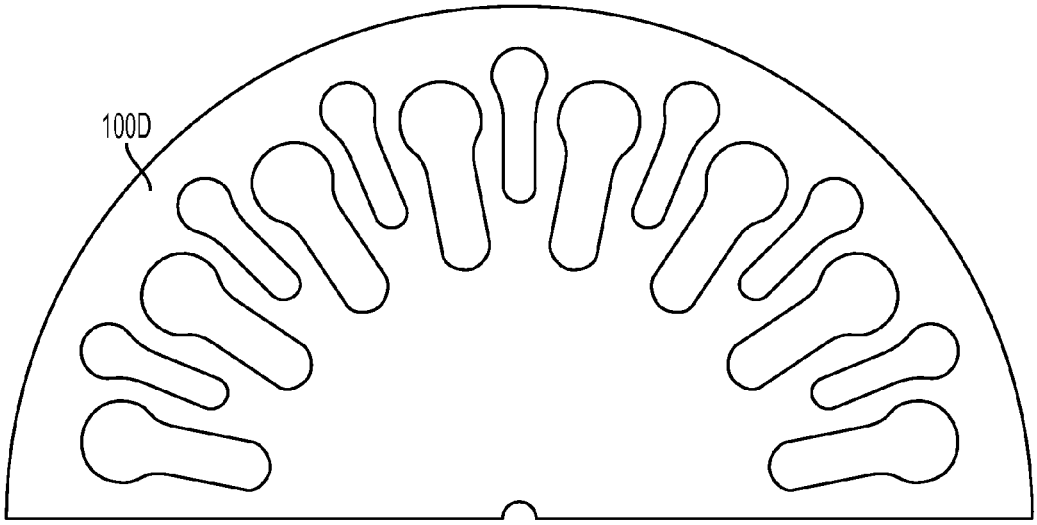

FIG. 5 is top perspective view of half of the top shelf of FIG. 3.

Figure 6:
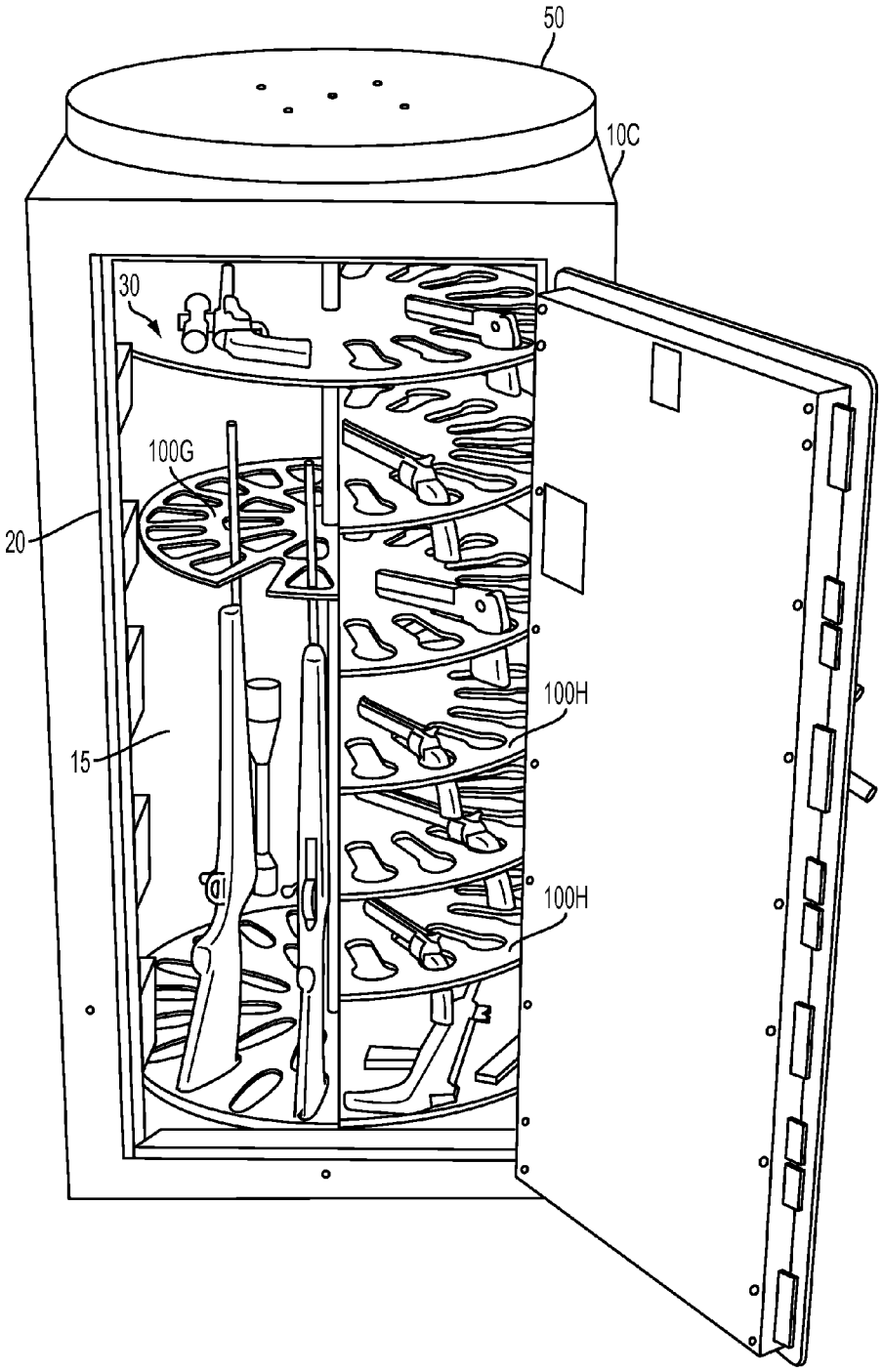

FIG. 6 is a front perspective view of a gun safe that is similar to the gun safe of FIG. 1, but in which the shelving arrangement has been modified to have a split shelving arrangement; the safe is partially loaded with firearms.

Figure 7:
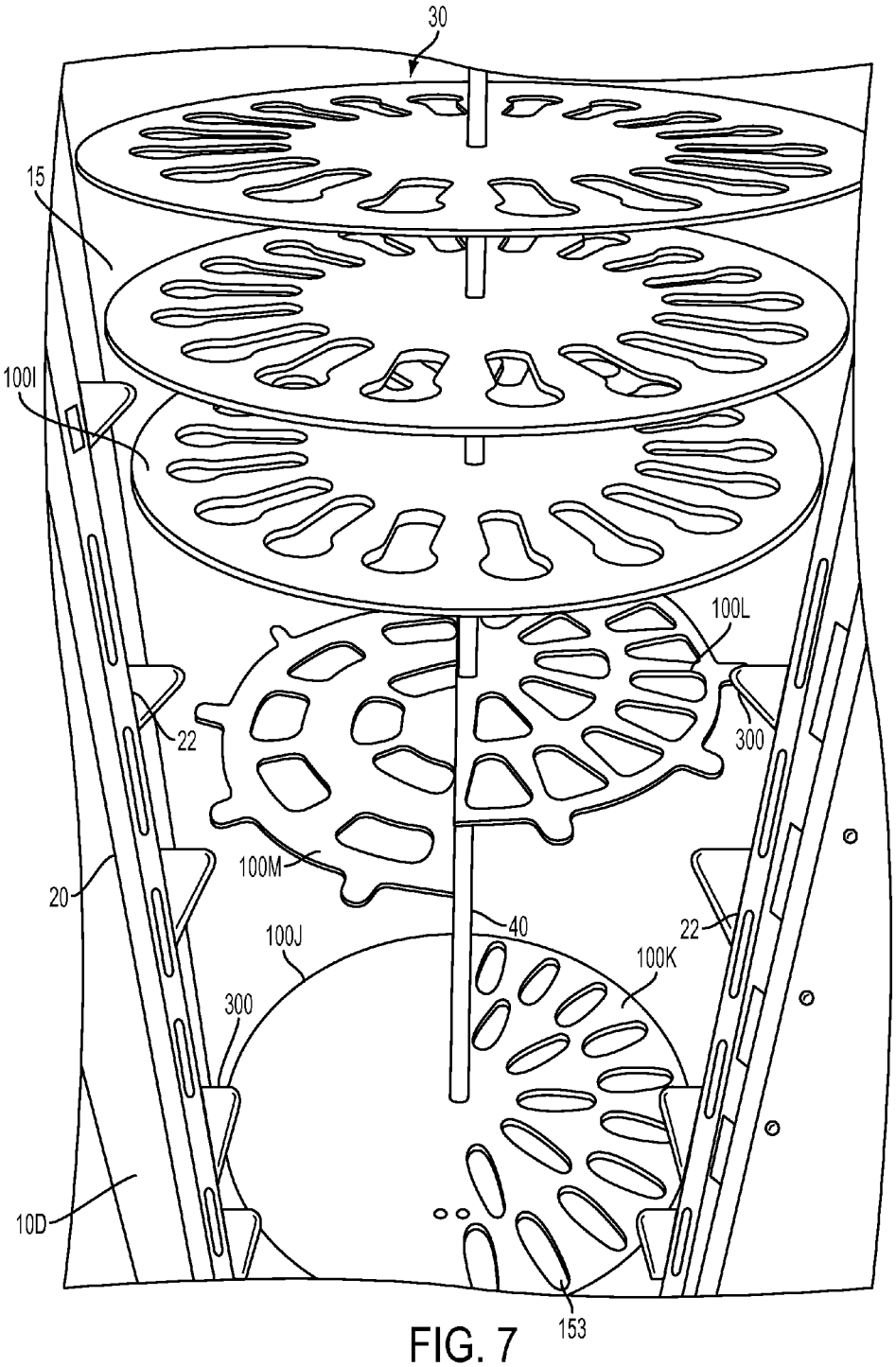

FIG. 7 is a front perspective view of the gun safe of FIG. 1 in which the shelving arrangement has been modified; the safe is not loaded with firearms.

Figure 8:
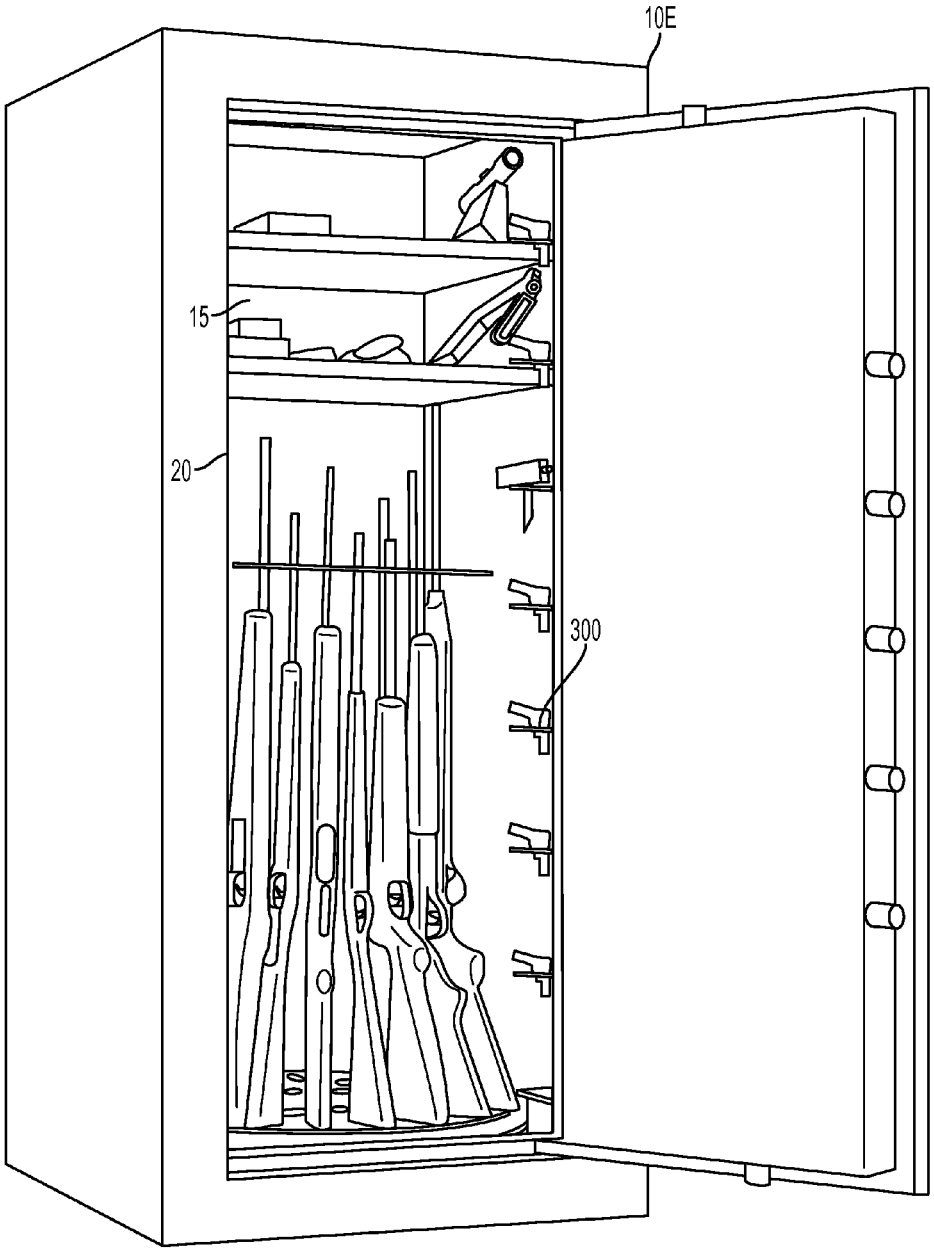

FIG. 8 is a front perspective view of a gun safe according to a further embodiment; this embodiment includes a vertical array of pistol shelves adjacent an interior lateral portion of the safe's door.

Figure 9:
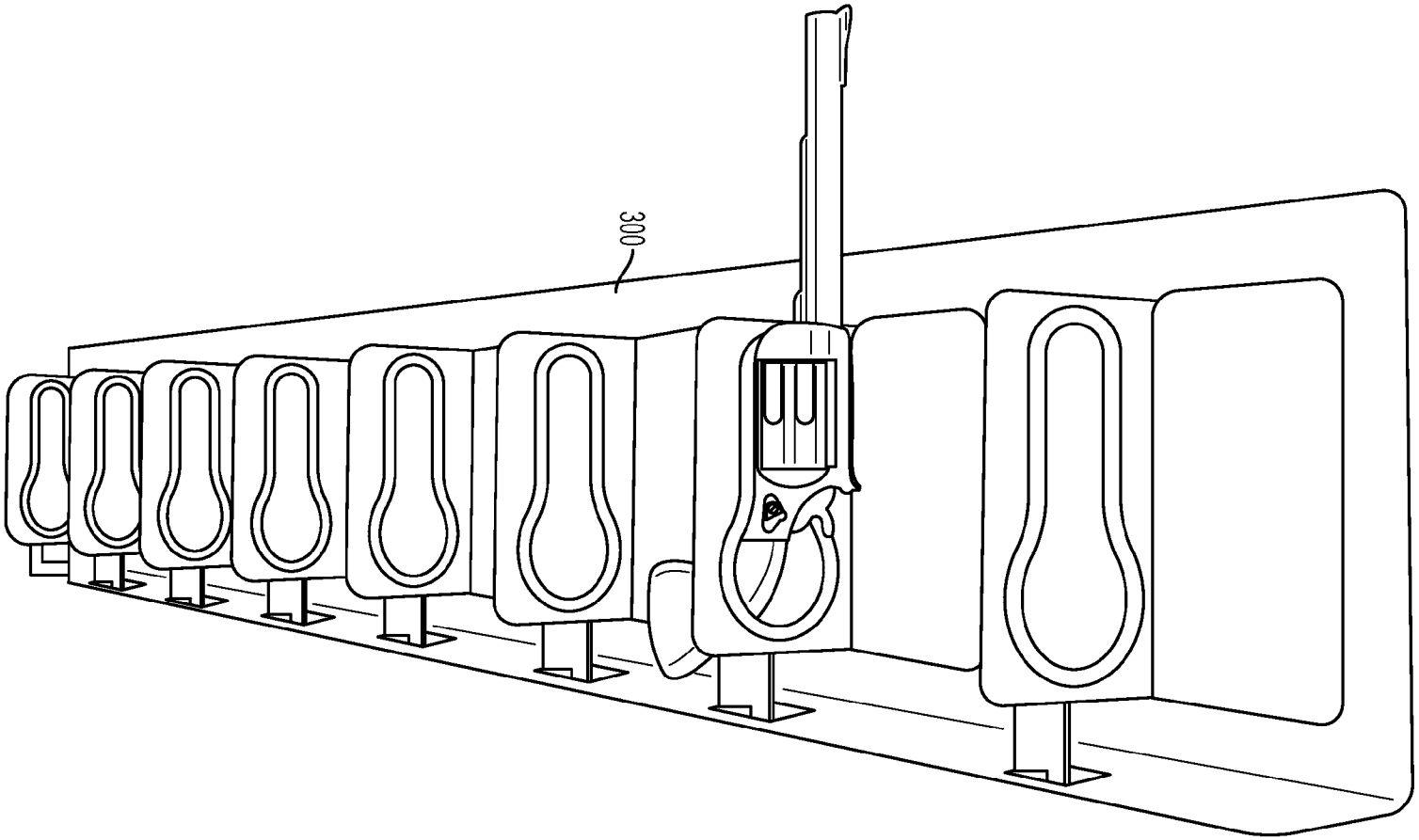
Figure 10:
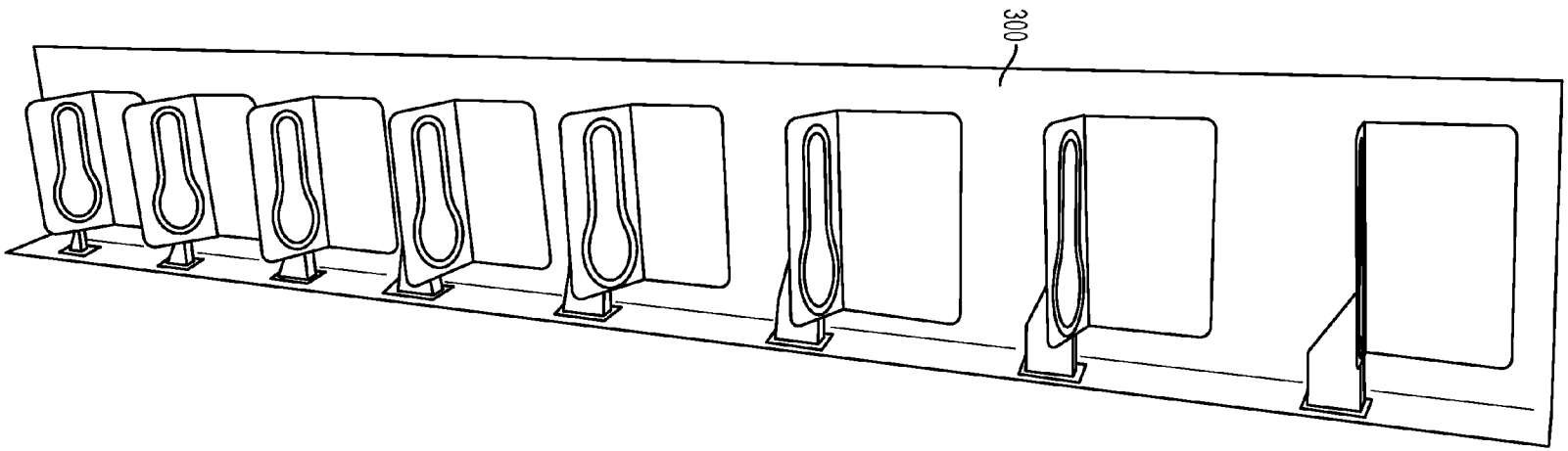

FIGS. 9 and 10 are front perspective views of the vertical arrays of pistol shelves shown in FIG. 8.

DETAILED DESCRIPTION OF VARIOUS EMBODIMENTS

Various embodiments now will be described more fully hereinafter with reference to the accompanying drawings. It should be understood that the invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overview

Gun safes according to various embodiments are adapted to hold relatively large numbers of handguns in a vertical rotating array of shelves that is positioned within the interior of the safe. In particular embodiments, one or more shelves in the array of shelves includes at least two differently sized cutouts that are each adapted to receive a range of different sizes of handguns.

In particular embodiments, the gun safe includes at least one shelf that includes both a plurality of relatively large, keyhole-shaped cutouts and a plurality of relatively small, keyhole-shaped cutouts. In a particular embodiment, the different sized keyhole-shaped cutouts are disposed (e.g., alternatingly) in an arcuate arrangement that extends at least partially around an exterior portion of a substantially circular or half-circular shelf. In particular embodiments, each of the keyhole-shaped cutouts is positioned so that its main axis is substantially co-liner with a radius of the shelf. This may help to allow for the storage of a large number of handguns in a relatively small space.

It should be understood that the shelves may include cutouts that are in a shape that is different from a keyhole shape. For example, the cutouts may be substantially diamond-shaped, substantially triangular, or substantially in the shape of a rectangle, oval, or any other suitable shape.

In particular embodiments, in addition to the rotating array of shelves described above, the gun safe may include one or more vertical arrays of pistol shelves immediately adjacent one or more lateral sides of the safe's access opening (e.g., in the respective forward interior corners of the safe). Each pistol shelf may include a cutout (e.g., a keyhole-shaped cutout) for receiving a pistol. Such vertical arrays of shelves may serve to expand the overall capacity of the gun safe.

Various embodiments of the gun safe may also be set up in a split configuration, such as the configuration shown in FIG. 6. In such a configuration, one side of the safe's rotating shelf assembly may be at least primarily adapted to receive and store long guns, while the other side of the safe's rotating shelf assembly may be adapted for receiving and storing handguns. This may allow for the efficient storage of both handguns and long guns in a relatively small space. Various embodiments of the gun safe are described in greater detail below

Exemplary Safe Embodiments

Gun safes according to various embodiments comprise: (1) a secure housing (e.g., a secure metal housing) that defines an interior storage chamber; (2) a door that is positioned for selectively preventing access to the interior storage chamber; (3) a rotatable shelving system; (4) one or more fixed handgun support shelves; and (5) an exterior rotating shelf. These various components are discussed in greater detail below.

Housing

FIGS. 1-10 show various embodiments of gun safes and different shelving arrangements that are adapted to be used within the gun safes to provide for efficient storage of handguns, long guns, ammunition, and other items (e.g., such a jewelry). Although much of the discussion below focuses on various embodiments of the safe shown in FIG. 1, it should be understood that other embodiments may be similar in structure and/or operation.

In the embodiment of FIG. 1, the gun safe 10 includes an outer housing that defines an interior storage chamber 15 that is dimensioned to store one or more valuable items, and a substantially rectangular access opening 20 through which a user may access items stored within the storage chamber 15. In particular embodiments, the safe 10 may have a substantially rectangular, U-shaped, or round footprint and/or cross section. In various embodiments, the safe housing 12 has a height of between about 60 inches and 80 inches. However, the gun safe 10 may have any suitable dimensions for storing valuables, such as guns and jewelry.

In particular embodiments, the safe's housing 12 may be made of any material that is suitable for preventing access to the safe's storage chamber. For example, the housing 12 may be made of a hard metal, such as steel and be formed with no (or minimal) gaps in the housing's structure. This may, for example, help to prevent or otherwise discourage intruders from prying open the safe 10 to access valuables stored within the safe's interior storage chamber 15.

Door

In various embodiments, the safe 10 comprises a secure door (e.g., a reinforced door) 28 that is rotatably attached adjacent the safe's access opening 20 via a plurality of hinges. In particular embodiments, the door 28 is mounted to allow a user to selectively prevent access to the safe's secure storage chamber 15 through the access opening 20. In various embodiments, the safe 10 further comprises a locking mechanism that is configured to selectively maintain the door 28 in a closed and locked orientation in which the door 28 prevents access to the storage chamber 15 via the access opening 20.

Rotatable Item Shelf Assembly

As shown in FIG. 1, in particular embodiments, the gun safe 10 comprises a rotatable item shelf assembly 30 that comprises a substantially vertical (e.g., vertical), central shaft 40 (that may, for example, have a substantially circular cross section). In particular embodiments, the central shaft 40 is rotatably attached to, and extends between, the inner top and bottom portions of the safe 10. In various embodiments, the shaft 40 is attached to the safe 10 via one or more bearings (not shown), which allows the shaft 40 to rotate about its central axis relative to the safe's secure housing 12.

As may be understood from FIG. 1, the gun safe 10 may include one or more internal, substantially horizontal shelves 100A-100K that are fixedly attached to the central shaft 40 so that, when then central shaft 40 rotates relative to the safe's secure housing 12, the shelves 100A also rotate within the safe about the shaft's central axis. This may be useful, for example, in allowing users to access items stored on the safe's shelves without having to reach deeply into the safe, or to remove items to access other items within the safe 10.

In various embodiments, each shelf 100A may be substantially circular and may be formed of two half-circular shelf pieces, such as the half-circular shelf piece 100H shown in FIG. 6. Each shelf may be, for example, separately attached to the central shaft 40 via, for example, any suitable fastener. Alternatively, the two half-circular shelf pieces may first be attached together and then attached to the central shaft 40 as a single piece.

As shown in FIG. 6, in a particular embodiment, one or more of the shelves 100H may be half circular (rather than circular), which may help to allow for different overall shelving configurations within the safe 10. In certain embodiments, the shelves 100A-100K are each attached to the central shaft 40 via removable fasteners that may or may not require tools for removal. This may, for example, allow a user to selectively change the position of one or more of the shelves 100A-100K within the safe 10.

In various embodiments, when the various shelves 100A-100K are installed on the central shaft 40, the respective outer perimeters of all or some of the shelves within a vertical array of shelves (e.g., a vertical array of 2-10 horizontal shelves) may be substantially vertically aligned with each other. For example, in the embodiment shown in FIG. 6, the six half circular shelves 100H on the right side of the safe form a vertical array in which the shelves 100H are oriented substantially horizontally and spaced vertically apart from one another, and in which the respective arcuate outer perimeters of the shelves 100H are vertically aligned with each other. Similarly, the substantially circular shelves 100A of the embodiment shown in FIG. 1 form a vertical array of shelves 100A in which the respective substantially circular outer perimeters of the various shelves 100A are vertically aligned with each other.

It should be understood that, while the various vertical arrangements of shelves are described above as, in some cases, having outer perimeters that align with one another, in other embodiments, two or more of the shelves may form a vertical array in which the shelves' respective outer perimeters are not vertically aligned.

Handgun Support Portions

In various embodiments, the safe's shelves may include one or more handgun support portions 130, 140 that are each adapted to vertically and/or laterally support a handgun (e.g., in a particular location on one of the shelves 100A-100K). Examples of such handgun support portions 130, 140 are shown, for example, in FIGS. 1 and 4. As may be understood from FIG. 4, each handgun support portion 130, 140 may, for example, include a cutout 132, 142 that is defined within a particular shelf 100D and, optionally, a flexible handgun support 134, 144 that extends at least partially around the perimeter of the cutout 132, 142. In various embodiments, at least a portion of the cutout 132, 142 is dimensioned to receive at least a portion of a handgun 200, 205, 210 through the cutout 132, 142, and the perimeter of the cutout 132, 142 is dimensioned so that, when the handgun 200, 205, 210 is positioned so that it extends partially through the cutout 132, 142, the portion of the shelf 100D that defines the perimeter vertically and/or laterally supports the handgun 200, 205, 210 in place on the shelf 100D. In a particular embodiment, the flexible nature of the handgun support 134, 144 helps to hold the handgun 200, 205, 210 in a fixed position by: (1) compressing when supporting the weight of the handgun 200, 205, 210; and (2) exerting compressive forces on opposite sides of the handgun 200, 205, 210. The handgun support 134, 144 may be made, for example, of rubber, plastic, leather, or any other suitable material.

As shown in FIG. 4, a particular handgun support 134, 144 may, for example, support a particular handgun 200, 205, 210 by exerting upward and/or lateral forces on opposite lateral sides of the handgun 200, 205, 210. For example, in FIG. 4, a particular handgun support 144 supports a relatively small revolver 210 by exerting upward and lateral forces on the revolver's chamber. Alternatively, a particular handgun support 134, 144 may support a particular handgun 200, 205, 210 by exerting upward and/or lateral forces on the barrel and/or one or more rear portions of the handgun (e.g., the handgun's hammer). As an example, a particular handgun support 134 in FIG. 4 supports a relatively large handgun 205 by exerting upward forces on the barrel and hammer portions of the handgun 205.

As may be understood from FIGS. 2-4, the cutouts 132, 142 of the various handgun support portions 130, 140 may be substantially keyhole-shaped and may be of any suitable size or combination of sizes. As an example, in FIG. 4, the shelf 100D includes a plurality of alternating large and small keyhole-shaped cutouts 132, 142. Each of the cutouts 132, 142 includes an elongated portion defined by substantially parallel sides and an arcuate connecting side that connects the two parallel sides. Opposite the arcuate connecting side is a bulbous grip-receiving portion that has a maximum width that is somewhat wider than the width of the cutout's elongated portion. This keyhole configuration may make it possible to use a particular cutout to support a variety of handguns of different sizes.

For example, in the embodiment shown in FIG. 4, a user may use a first small cutout 144 to support and store a very small revolver 210 by inserting the revolver's grip through the cutout's bulbous grip receiving portion and then resting the chamber of the revolver 210 on the portions of the flexible handgun support 144 that are adjacent the cutout's elongated portion as shown in FIG. 4. Similarly, a user may use a second small cutout 144 having the same dimensions as the first small cutout 144 to support a medium-sized revolver 200 by inserting the grip of the medium-sized revolver 200 through the cutout's bulbous grip-receiving portion so that the barrel of the revolver 200 is supported by a portion of the handgun support 144 adjacent the cutout's arcuate side portion, and the revolver's hammer is supported by a portion of the handgun support 144 adjacent the cutout's grip-receiving portion.

In a particular embodiment, in order to maximize the number of handgun supports 134, 144 that may fit on a particular shelf 100D, the shelf 100D may include an alternating, arcuate arrangement of relatively large and relatively small handgun supports adjacent the perimeter of the shelf 100D (See FIG. 4). As shown in FIG. 4, in various embodiments, the central axis of each keyhole-shaped cutout 132, 142 of each handgun support 134, 144 is at least substantially co-linear with a radius of the shelf 100D. However, the keyhole-shaped cutouts 132, 142 may be in any other, suitable orientation.

In the embodiment shown in FIG. 4, the respective cutouts 132, 142 of the relatively large handgun supports 130 are positioned equidistantly away from the center of the shelf 100D, and are spaced at least substantially equidistantly apart from each other about the circumference of the shelf 100D. Similarly, the respective cutouts 132, 142 of the relatively small handgun supports 144 are positioned equidistantly away from the center of the shelf 100D, and are spaced at least substantially equidistantly apart from each other around the circumference of the shelf 100D. In the embodiment shown in FIG. 4, each relatively small handgun support 144 is positioned between two relatively large handgun supports 134 so that the widest part of each large handgun support's grip-receiving portion is positioned adjacent the transition between the elongated portion and the grip receiving portion of the small handgun support's cutout 142.

As discussed above, in various embodiments, the safe 10 may include multiple half-circular shelves, and may include shelves for supporting both long guns and handguns. FIG. 7 shows an example of a split shelving arrangement in which the safe includes a lower half shelf 100K that includes a plurality of long gun butt supports 153, a lower half shelf 100J that defines a solid upper surface, two half shelves 100L, 100M for providing lateral support to the barrels of long guns, and three full circular upper shelves that are each adapted for supporting and storing a plurality of handguns in the shelves' respective keyhole-shaped cutouts.

It should be understood that the various shelves may include any suitable number of cutouts 132, 142. For example, each circular shelf may include between 2 and 36 cutouts (e.g., 30 cutouts), or any other suitable number of cutouts.

Fixed Interior Shelves

As shown in FIG. 7, the safe 10 may include one or more fixed shelves that are positioned adjacent an inner surface of the secure housing between the rotating shelf assembly 30 and the interior of the secure housing 12. In the embodiment shown in FIG. 7, the safe 100 includes a first vertical array of pistol shelves 300 adjacent a first lateral side of the safe's access opening 20 (e.g., in a first front corner of the safe), and a second vertical array of pistol shelves 300 adjacent a second lateral side of the safe's access opening 20 (e.g., in a second front corner of the safe). FIGS. 9 and 10 show example vertical arrays of pistol shelves 300. As may be understood from these figures, each vertical array 300 may include a substantially rectangular, substantially horizontal shelf that includes a handgun support portion, such as those described in greater detail above.

Additional Shelves

In various embodiments, the safe may comprise one or more additional shelves that are disposed within the safe housing in an area between the top of the rotatable item support and the interior roof of the safe housing. In particular embodiments, the additional shelves are substantially fixed with respect to the safe housing.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Rifle or pistol supports, may, for example, be configured to support other items or other varieties of weaponry (e.g., shotguns, swords, etc.), or other valuables. Therefore, it is to be understood that the invention is not to be limited to the specific embodiments disclosed and that the modifications and other embodiments are intended to be included within the scope of the appended exemplary concepts. Although specific terms are employed herein, they are used in a generic and descriptive sense only and not for the purposes of limitation.

What is claimed is:

1. A gun safe comprising:

a secure housing defining an interior and an opening;

a door that is movable between:

a first, open position in which the door prevents access to the interior of the secure housing; and a second, closed position in which the door does not prevent access to the interior of the secure housing;

a shelving arrangement that is adapted to rotate about a central axis, wherein:

the shelving arrangement comprises:

a first vertical array of half-circular shelves, each half-circular shelf within the first vertical array being positioned so that its outer perimeter at least substantially aligns with the respective outer perimeters of the other shelves in the first array;

a second vertical array of half-circular shelves, each particular half-circular shelf within the second vertical array being positioned so that the outer perimeter of the particular half-circular shelf at least substantially aligns with the respective outer perimeters of the other shelves in the second array; and at least one of the first vertical array of half-circular shelves and at least one of the second vertical array of half-circular shelves cooperate to form a substantially circular shelf.

2. The gun safe of claim 1, wherein:

at least one shelf in the first vertical array of half-circular shelves is adapted to hold at least 12 handguns in an arrangement of cutouts that are defined within the half circular portion adjacent an outer perimeter of the half circular portion; and a second, half circular portion that comprises a plurality of long gun butt supports, each particular one of the gun butt supports being adapted to at least substantially conform to a butt of a respective handgun as the particular gun butt support supports a particular long gun.

3. The gun safe of claim 1, wherein:

at least one shelf in the first vertical array of half-circular shelves comprises a handgun support portion that comprises a cutout that is dimensioned to allow a portion of a handgun to extend through the cutout as the handgun is supported on opposite sides of the handgun by the shelf.

4. The gun safe of claim 3, wherein:

the handgun support portion comprises a flexible handgun support that extends around at least a portion of a perimeter of the cutout; and the cutout and the flexible handgun support are dimensioned so that, as a first portion of a handgun extends through the cutout, a second portion of the handgun is supported on opposite sides of the second portion of the handgun by the flexible handgun support.

5. The gun safe of claim 3, wherein the cutout is substantially in the shape of a keyhole.

6. The gun safe of claim 3, wherein the handgun support portion comprises a chamber support adjacent an elongated portion of the cutout that is dimensioned for supporting opposite sides of the chamber of a handgun as at least a portion of the chamber extends through the cutout.

7. The gun safe of claim 1, wherein the housing consists essentially of metal.

8. The gun safe of claim 1, wherein:

at least one particular shelf within the first vertical array of half-circular shelves comprises a plurality of first types of cutouts and a plurality of second types of cutouts; and the first and second types of cutouts are alternatingly disposed in a substantially arc-shaped arrangement relative to the shelf.

9. The gun safe of claim 7, wherein;

at least one shelf within the first vertical array of half-circular shelves defines a substantially arcuate outer edge; and the first and second types of cutouts are alternatingly disposed in at least substantially along an arc that is concentric with the arcuate outer edge.

10. The gun safe of claim 7, wherein the first and second types of cutouts are substantially keyhole-shaped.

11. The gun safe of claim 1, wherein the substantially circular shelf is mounted to rotate relative to the secure housing so that all cutouts in the substantially circular shelf pass by the opening as the substantially circular shelf rotates 360 degrees about its axis of rotation.

* * * * *